US010463208B2

(12) United States Patent
Morikawa et al.

(10) Patent No.: US 10,463,208 B2
(45) Date of Patent: Nov. 5, 2019

(54) TOILET SEAT/TOILET LID DEVICE

(71) Applicant: LIXIL Corporation, Tokyo (JP)

(72) Inventors: Yudai Morikawa, Tokyo (JP); Isato Hirasawa, Tokyo (JP)

(73) Assignee: LIXIL Corporation, Tokyo (JP)

( * ) Notice: Subject to any disclaimer, the term of this patent is extended or adjusted under 35 U.S.C. 154(b) by 0 days.

(21) Appl. No.: 16/069,504

(22) PCT Filed: Jan. 4, 2017

(86) PCT No.: PCT/JP2017/000037
§ 371 (c)(1),
(2) Date: Jul. 11, 2018

(87) PCT Pub. No.: WO2017/122558
PCT Pub. Date: Jul. 20, 2017

(65) Prior Publication Data

US 2019/0000284 A1 Jan. 3, 2019

(30) Foreign Application Priority Data

Jan. 15, 2016 (JP) ..... 2016-006411

(51) Int. Cl.
*A47K 13/00* (2006.01)
*A47K 13/12* (2006.01)
*A47K 13/10* (2006.01)

(52) U.S. Cl.
CPC ..... *A47K 13/00* (2013.01); *A47K 13/10* (2013.01); *A47K 13/12* (2013.01)

(58) Field of Classification Search
CPC ..... A47K 13/00
USPC ..... 4/34
See application file for complete search history.

(56) References Cited

FOREIGN PATENT DOCUMENTS

| | | |
|---|---|---|
| JP | 1-101948 | 4/1989 |
| JP | 3-67194 | 6/1991 |
| JP | 2004-223049 | 8/2004 |
| JP | 2014-217779 | 11/2014 |

OTHER PUBLICATIONS

International Search Report dated Mar. 21, 2017, directed to International Application No. PCT/JP2017/000037; 2 pages.

*Primary Examiner* — Lori L Baker
(74) *Attorney, Agent, or Firm* — Morrison & Foerster LLP

(57) ABSTRACT

A toilet seat/toilet lid device includes a toilet seat and a toilet lid that are provided to be pivotable with respect to a toilet between an erected state and a laid state; a toilet seat drive device that is configured to cause the toilet seat to pivot; a toilet seat pivot shaft that extends from the toilet seat drive device to one side of the toilet in a width direction, pivotably supports the toilet seat and supports the toilet lid; a toilet lid drive device that is configured to cause the toilet lid to pivot; and a toilet lid pivot shaft that extends from the toilet lid drive device to the other side of the toilet in the width direction, pivotably supports the toilet lid, and supports the toilet seat.

4 Claims, 15 Drawing Sheets

TOILET SEAT/TOILET LID DEVICE

REFERENCE TO RELATED APPLICATIONS

This application is a national stage application under 35 USC 371 of International Application No. PCT/JP2017/000037, filed Jan. 4, 2017, which claims the priority of Japanese Application No. 2016-006411, filed Jan. 15, 2016, the entire contents of each of which are incorporated herein by reference.

FIELD OF THE INVENTION

The present invention relates to a toilet seat/toilet lid device.

BACKGROUND OF THE INVENTION

In the related art, a flush toilet including a body portion which is installed on a toilet and a toilet seat and a toilet lid which are provided to be pivotable with respect to the body portion is known (refer to Patent Document 1 below).

In addition, a toilet, in which a motor for opening and closing a toilet seat and a motor for opening and closing a toilet lid are provided inside one unit so as to electrically open and close the toilet seat and the toilet lid, one pivot shaft is coupled to both the motor for opening and closing a toilet seat and the motor for opening and closing a toilet lid, and the toilet seat and the toilet lid are pivotally supported by the pivot shaft, is known.

The toilet seat or the toilet lid is configured to be opened and closed in response to the motor for opening and closing a toilet seat or the motor for opening and closing a toilet lid which is selectively driven.

In addition, there is a toilet in which a motor for opening and closing a toilet seat is provided inside one unit and a motor for opening and closing a toilet lid is provided inside the other unit. A pivot shaft of the toilet seat coupled to the motor for opening and closing a toilet seat and a pivot shaft of the toilet lid coupled to the motor for opening and closing a toilet lid are independently provided. Generally, the pivot shaft of the toilet lid is arranged at the rear of the pivot shaft of the toilet seat.

Patent Document 1 Japanese Unexamined Patent Application, First Publication No. 2014-217779.

SUMMARY OF THE INVENTION

Incidentally, in a configuration in which a toilet seat and a toilet lid pivot with one pivot shaft, a motor for opening and closing the toilet seat and a motor for opening and closing the toilet lid are collectively provided inside one unit, thereby leading to a problem that the unit is increased in size.

In addition, in a configuration in which a pivot shaft of a toilet seat and a pivot shaft of a toilet lid are independent of each other, the toilet lid extends rearward (opposite side of a person sitting on a flush toilet) beyond the pivot shaft of the toilet seat, thereby leading to a problem that the toilet lid is lengthened in a front-rear direction and the toilet lid is increased in size.

Therefore, the present invention has been made in consideration of the foregoing circumstances and provides a toilet seat/toilet lid device which can have a compact configuration.

According to a first aspect of the present invention, there is provided a toilet seat/toilet lid device including a toilet seat and a toilet lid, a toilet seat drive device, a toilet seat pivot shaft, a toilet lid drive device, and a toilet lid pivot shaft. The toilet seat and the toilet lid are provided to be pivotable with respect to a toilet between an erected state and a laid state. The toilet seat drive device causes the toilet seat to pivot. The toilet seat pivot shaft extends from the toilet seat drive device to one side of the toilet in a width direction, pivotably supports the toilet seat, and supports the toilet lid. The toilet lid drive device causes the toilet lid to pivot. The toilet lid pivot shaft extends from the toilet lid drive device to the other side of the toilet in the width direction, pivotably supports the toilet lid, and supports the toilet seat. The toilet seat pivot shaft and the toilet lid pivot shaft are arranged on the same axis in the width direction of the toilet.

According to the configuration described above, the toilet seat pivot shaft pivotably supporting the toilet seat and the toilet lid pivot shaft pivotably supporting the toilet lid are arranged on the same axis in the width direction of the toilet. Thus, compared to a configuration in which the toilet seat pivot shaft and the toilet lid pivot shaft are arranged while deviating from the axis, it is possible to realize a configuration in which the length in a horizontal direction orthogonal to the width direction of the toilet, and the height are suppressed.

In addition, for example, if the toilet seat drive device causing the toilet seat pivot shaft to pivot and the toilet lid drive device causing the toilet lid pivot shaft to pivot are distantly arranged, compared to a configuration of being collectively installed in one place, it is possible to realize a configuration in which the size of the toilet seat/toilet lid device is suppressed.

Therefore, the length in the horizontal direction orthogonal to the width direction of the toilet, the height, and the size are suppressed, and it is possible to realize an entirely compact configuration.

In the toilet seat/toilet lid device according to the first aspect, a toilet seat side fitting hole in which the toilet seat pivot shaft is arranged and a toilet seat side supporting hole in which the toilet lid pivot shaft is arranged are formed in the toilet seat. A toilet lid side supporting hole in which the toilet seat pivot shaft is arranged and a toilet lid side fitting hole in which the toilet lid pivot shaft is arranged are formed in the toilet lid. The toilet seat pivot shaft is arranged to be fitted into the toilet seat side fitting hole, is capable of corotating with the toilet seat, and is slidably arranged in the toilet lid side supporting hole. The toilet lid pivot shaft is slidably arranged in the toilet seat side supporting hole, is arranged to be fitted into the toilet lid side fitting hole, and is capable of corotating with the toilet lid.

According to the configuration described above, the toilet seat pivot shaft is arranged to be fitted into the toilet seat side fitting hole formed in the toilet seat and is capable of corotating with the toilet seat. Thus, when the toilet seat pivot shaft pivots, the toilet seat pivots together with the toilet seat pivot shaft. In addition, the toilet lid pivot shaft is slidably arranged in the toilet seat side supporting hole formed in the toilet seat. Thus, the toilet seat slides around the toilet lid pivot shaft. Therefore, the toilet seat smoothly pivots between the erected state and the laid state.

In addition, the toilet lid pivot shaft is arranged to be fitted into the toilet lid side fitting hole formed in the toilet lid and is capable of corotating with the toilet lid. Thus, when the toilet lid pivot shaft pivots, the toilet lid pivots together with the toilet lid pivot shaft.

In addition, the toilet seat pivot shaft is slidably arranged in the toilet lid side supporting hole formed in the toilet lid.

Thus, the toilet lid slides around the toilet seat pivot shaft. Therefore, the toilet lid smoothly pivots between the erected state and the laid state.

In the toilet seat/toilet lid device according to the second aspect, the toilet seat pivot shaft has an oval toilet seat pivot shaft portion and a completely round toilet lid pivot shaft portion. The oval toilet seat pivot shaft portion is arranged in the toilet seat side fitting hole and is formed to have a substantially oval cross section. The completely round toilet lid pivot shaft portion is arranged in the toilet lid side supporting hole and is formed to have a completely round cross section. The toilet lid pivot shaft has a completely round toilet seat pivot shaft portion and an oval toilet lid pivot shaft portion. The completely round toilet seat pivot shaft portion is arranged in the toilet seat side supporting hole and is formed to have a completely round cross section. The oval toilet lid pivot shaft portion is arranged in the toilet lid side fitting hole and is formed to have a substantially oval cross section. The toilet seat side fitting hole is formed to have a substantially oval cross section corresponding to a shape of the oval toilet seat pivot shaft portion. The toilet seat side supporting hole is formed to have a completely round cross section slightly greater than a cross section of the completely round toilet seat pivot shaft portion. At least a part of the toilet lid side supporting hole is formed to have a completely round cross section slightly greater than a cross section of the completely round toilet lid pivot shaft portion. At least a part of the toilet lid side fitting hole is formed to have a substantially oval cross section corresponding to a shape of the oval toilet lid pivot shaft portion.

According to the configuration described above, the oval toilet seat pivot shaft portion of the toilet seat pivot shaft is arranged to be fitted into the toilet seat side fitting hole which is formed to have a substantially oval cross section corresponding to the shape of the oval toilet seat pivot shaft portion. Thus, when the toilet seat pivot shaft pivots, the toilet seat reliably pivots together with the toilet seat pivot shaft. In addition, the completely round toilet seat pivot shaft portion of the toilet lid pivot shaft is slidably arranged in the toilet seat side supporting hole which is formed to have a completely round cross section slightly greater than the cross section of the completely round toilet seat pivot shaft portion. Thus, the toilet seat reliably slides around the toilet lid pivot shaft.

In addition, the oval toilet lid pivot shaft portion of the toilet lid pivot shaft is arranged to be fitted into the toilet lid side fitting hole in which at least a part thereof is formed to have a substantially oval cross section corresponding to the shape of the oval toilet lid pivot shaft portion. Thus, when the toilet lid pivot shaft pivots, the toilet lid reliably pivots together with the toilet lid pivot shaft. In addition, the completely round toilet lid pivot shaft portion of the toilet seat pivot shaft is slidably arranged in the toilet lid side supporting hole in which at least a part thereof is formed to have a completely round cross section slightly greater than the cross section of the completely round toilet lid pivot shaft portion. Thus, the toilet lid reliably slides around the toilet seat pivot shaft.

According to the toilet seat/toilet lid device described above, it is possible to realize a compact configuration.

DETAILED DESCRIPTION OF THE INVENTION

A toilet seat device will be described as an embodiment of the present invention.

Figure 1:
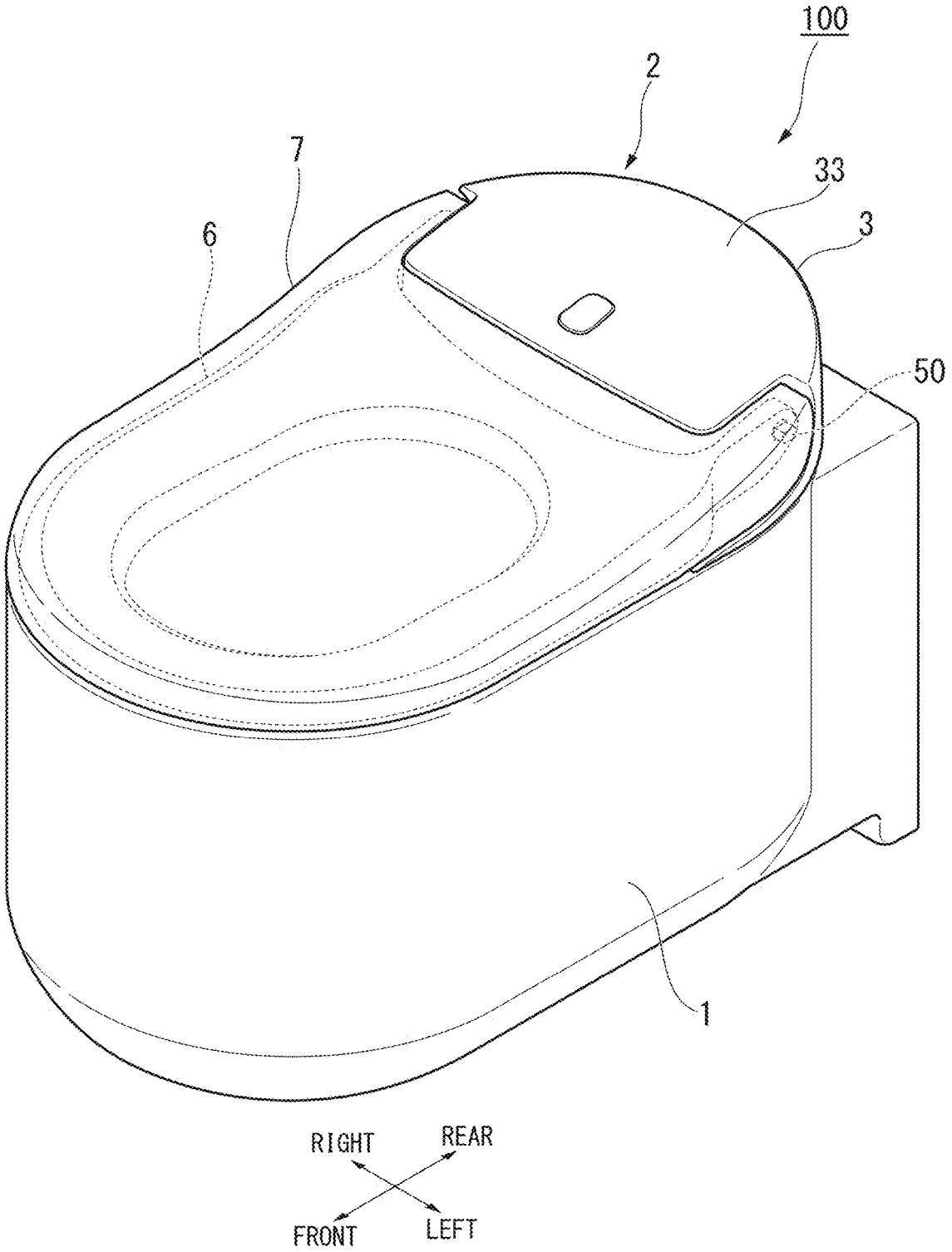
FIG. 1 is a perspective view of a flush toilet including a toilet seat/toilet lid device according to an embodiment of the present invention.

FIG. 1 is a perspective view of a flush toilet including a toilet seat/toilet lid device according to the embodiment of the present invention.

As shown in FIG. 1, a flush toilet 100 includes a ceramic toilet main body (toilet) 1 and a toilet seat unit (toilet seat/toilet lid device) 2 which is installed in the toilet main body 1.

Figure 2:
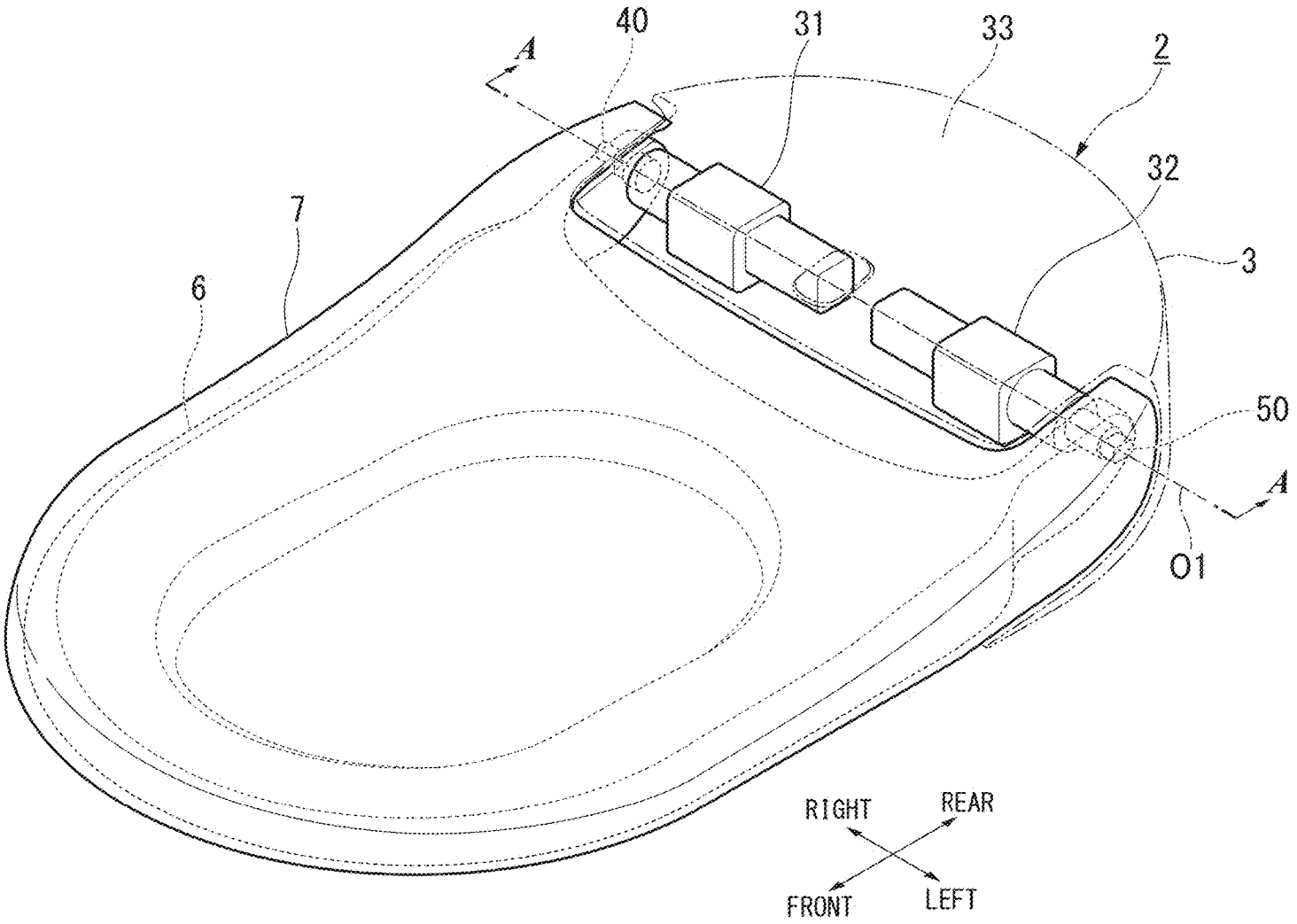
FIG. 2 is a perspective view of the toilet seat/toilet lid device according to the embodiment of the present invention.

FIG. 2 is a perspective view of the toilet seat unit 2.

As shown in FIGS. 1 and 2, the toilet seat unit 2 has a body portion 3 and a toilet lid 7. The body portion 3 is attached to an upper surface of a rear portion of the toilet main body 1. The toilet lid 7 is provided to be pivotable with respect to the body portion 3.

Here, a direction in which the face of a user sitting on a toilet seat 6 is directed will be referred to as a front side, and a direction in which the back of the user sitting on the toilet seat 6 is directed will be referred to as a rear side. While a horizontal direction orthogonal to this front-rear direction is a lateral direction (width direction of the flush toilet 100), a right side seen from the user (one side in the width direction) will be referred to as the right side, and a left side seen from the user (the other side in the width direction) will be referred to as the left side.

The body portion 3 has a toilet seat motor (toilet seat drive device) 31, a toilet seat pivot shaft 40, a toilet lid motor (toilet lid drive device) 32, a toilet lid pivot shaft 50, and a casing portion 33. The toilet seat motor 31 causes the toilet seat 6 to pivot. The toilet seat pivot shaft 40 is coupled to the toilet seat motor 31. The toilet lid motor 32 causes the toilet lid 7 to pivot. The toilet lid pivot shaft 50 is coupled to the toilet lid motor 32. The casing portion 33 accommodates the toilet seat motor 31, the toilet seat pivot shaft 40, the toilet lid motor 32, and the toilet lid pivot shaft 50.

Figure 3:
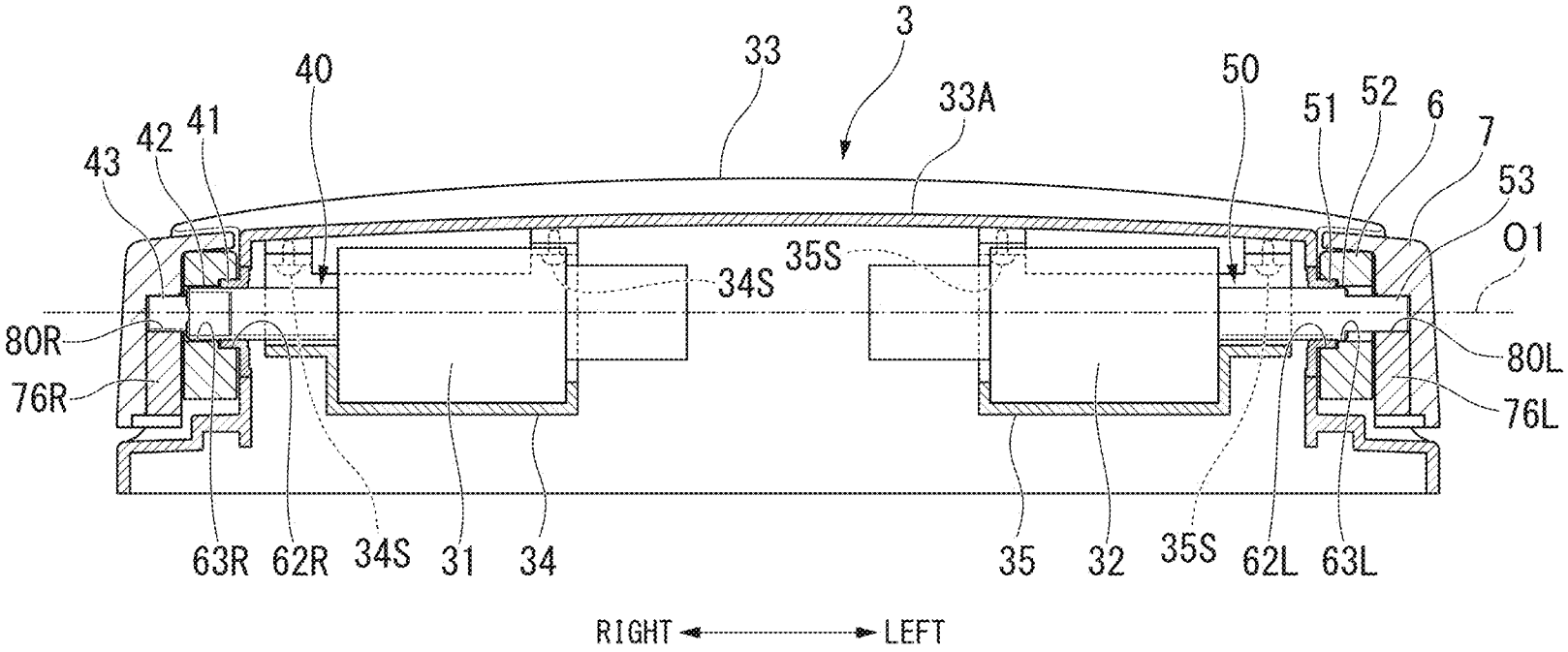
FIG. 3 is a cross-sectional view of A-A in FIG. 2.

FIG. 3 is a cross-sectional view of A-A in FIG. 2.

As shown in FIG. 3, on a back side of an upper surface 33A of the casing portion 33, a support base 34 is fixed with a screw 34S on the right side, and a support base 35 is fixed with a screw 35S on the left side. The support bases 34 and 35 are arranged separately in the lateral direction.

The toilet seat motor 31 is fixed to the support base 34 with a screw (not shown). The toilet lid motor 32 is fixed to the support base 35 with a screw (not shown). In this way, the toilet seat motor 31 and the toilet lid motor 32 are provided separately from each other in the lateral direction.

Figure 4:
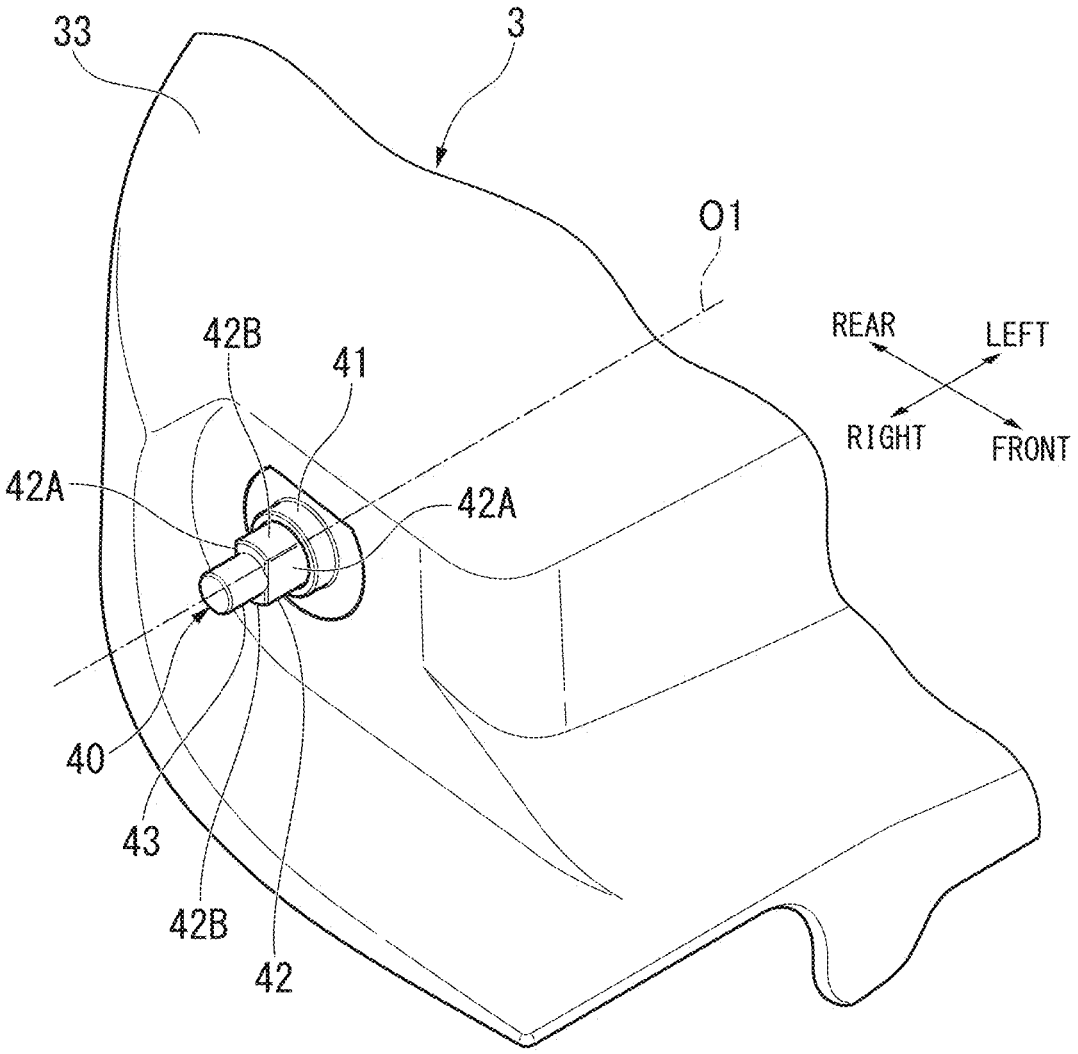
FIG. 4 is a perspective view of a toilet seat pivot shaft of the toilet seat/toilet lid device according to the embodiment of the present invention.
Figure 5:
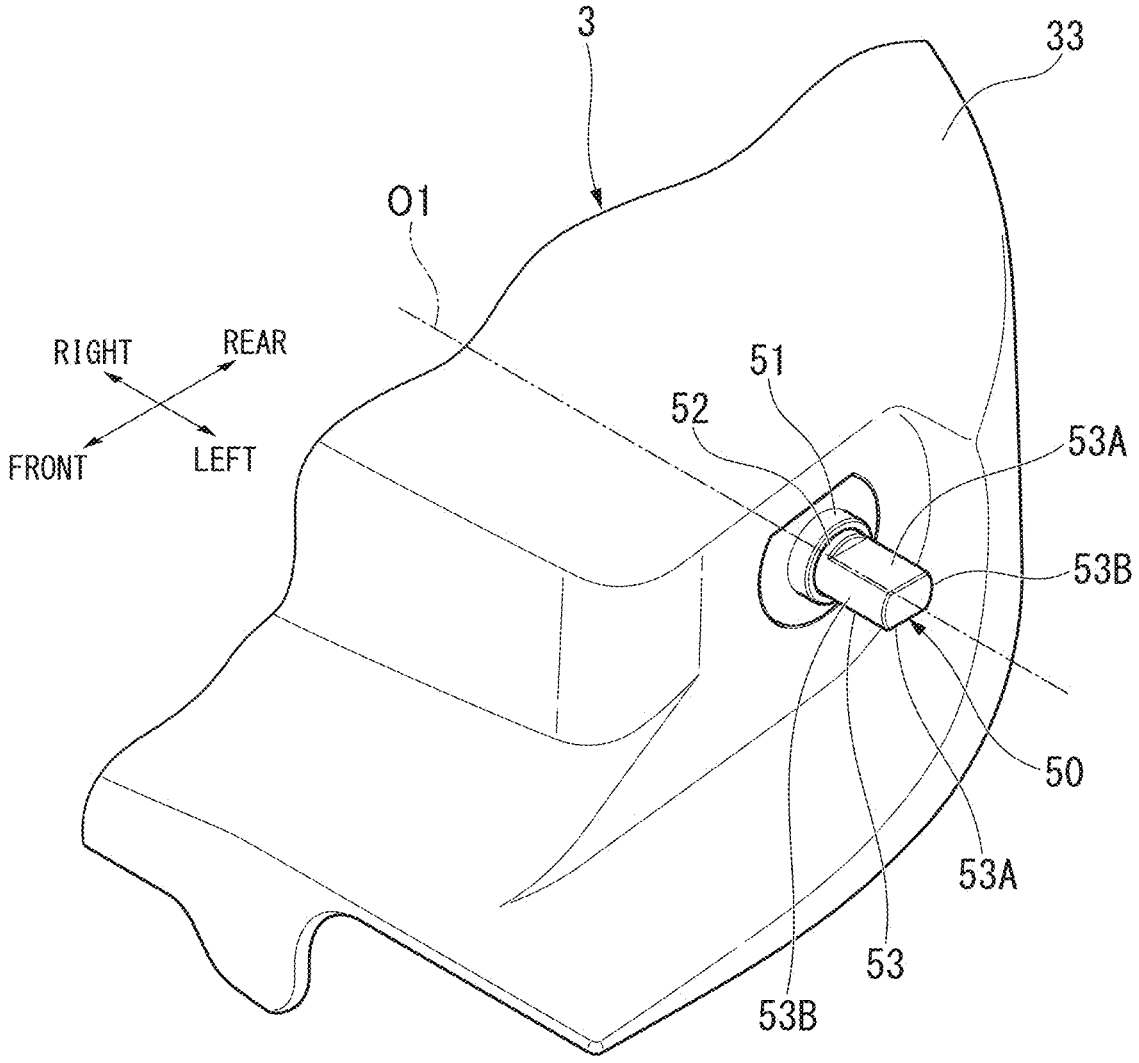
FIG. 5 is a perspective view of a toilet lid pivot shaft of the toilet seat/toilet lid device according to the embodiment of the present invention.

FIG. 4 is a perspective view of the toilet seat pivot shaft 40. FIG. 5 is a perspective view of the toilet lid pivot shaft 50.

As shown in FIGS. 3 and 4, the toilet seat pivot shaft 40 has a base end shaft portion 41, a toilet seat fitting shaft portion (oval toilet seat pivot shaft portion) 42, and a toilet lid supporting shaft portion (completely round toilet lid pivot shaft portion) 43. The base end shaft portion 41 is coupled to the toilet seat motor 31 and extends to the right side. The toilet seat fitting shaft portion 42 is connected to the base end shaft portion 41 and extends to the right side. The toilet lid supporting shaft portion 43 is connected to the toilet seat fitting shaft portion 42 and extends to the right side.

The base end shaft portion 41 is formed to have a circular cross section. The toilet seat fitting shaft portion 42 is formed to have a substantially oval cross section. In a state where the toilet seat 6 and the toilet lid 7 are closed as shown in FIG. 2, the toilet seat fitting shaft portion 42 forms a substantially oval shape elongated in a vertical direction.

As shown in FIG. 4, the toilet seat fitting shaft portion 42 has a pair of flat surface portions 42A and a pair of curved portions 42B. The pair of flat surface portions 42A is arranged separately from each other (arranged separately in the front-rear direction in a state as shown in FIG. 2) and is formed to have a flat surface shape. The curved portions 42B cause end portions of the pair of flat surface portions 42A to be coupled to each other and are formed to have a curved shape.

The toilet lid supporting shaft portion 43 is formed to have a completely round cross section. A center axis of the toilet lid supporting shaft portion 43 and a center axis of the toilet seat fitting shaft portion 42 are arranged on the same axis O1 in the lateral direction.

As shown in FIGS. 3 and 5, the toilet lid pivot shaft 50 has a base end shaft portion 51, a toilet seat supporting shaft portion (completely round toilet seat pivot shaft portion) 52, and a toilet lid fitting shaft portion (oval toilet lid pivot shaft portion) 53.

The base end shaft portion 51 is coupled to the toilet lid motor 32 and extends to the left side. The base end shaft portion 51 is formed to have a circular cross section. The toilet seat supporting shaft portion 52 is connected to the base end shaft portion 51 and extends to the left side. The toilet seat supporting shaft portion 52 is formed to have a completely round cross section. The toilet lid fitting shaft portion 53 is connected to the toilet seat supporting shaft portion 52 and continuously extends to the left side. The toilet lid fitting shaft portion 53 is formed to have a substantially oval cross section. In the state where the toilet seat 6 and the toilet lid 7 are closed as shown in FIG. 2, the toilet lid fitting shaft portion 53 forms a substantially oval shape elongated in the front-rear direction.

As shown in FIG. 5, the toilet lid fitting shaft portion 53 has a pair of flat surface portions 53A and a pair of curved portions 53B. The pair of flat surface portions 53A is arranged separately from each other (arranged separately in the vertical direction in a state as shown in FIG. 2) and is formed to have a flat surface shape. The curved portions 53B cause end portions of the pair of flat surface portions 53A to be coupled to each other and are formed to have a curved shape. A center axis of the toilet lid fitting shaft portion 53 and a center axis of the toilet seat supporting shaft portion 52 are arranged on the same axis O1 in the lateral direction.

As shown in FIGS. 2 and 3, the toilet seat motor 31, the toilet lid motor 32, the toilet seat pivot shaft 40, and the toilet lid pivot shaft 50 are arranged on the same axis O1 in the lateral direction.

Figure 6:
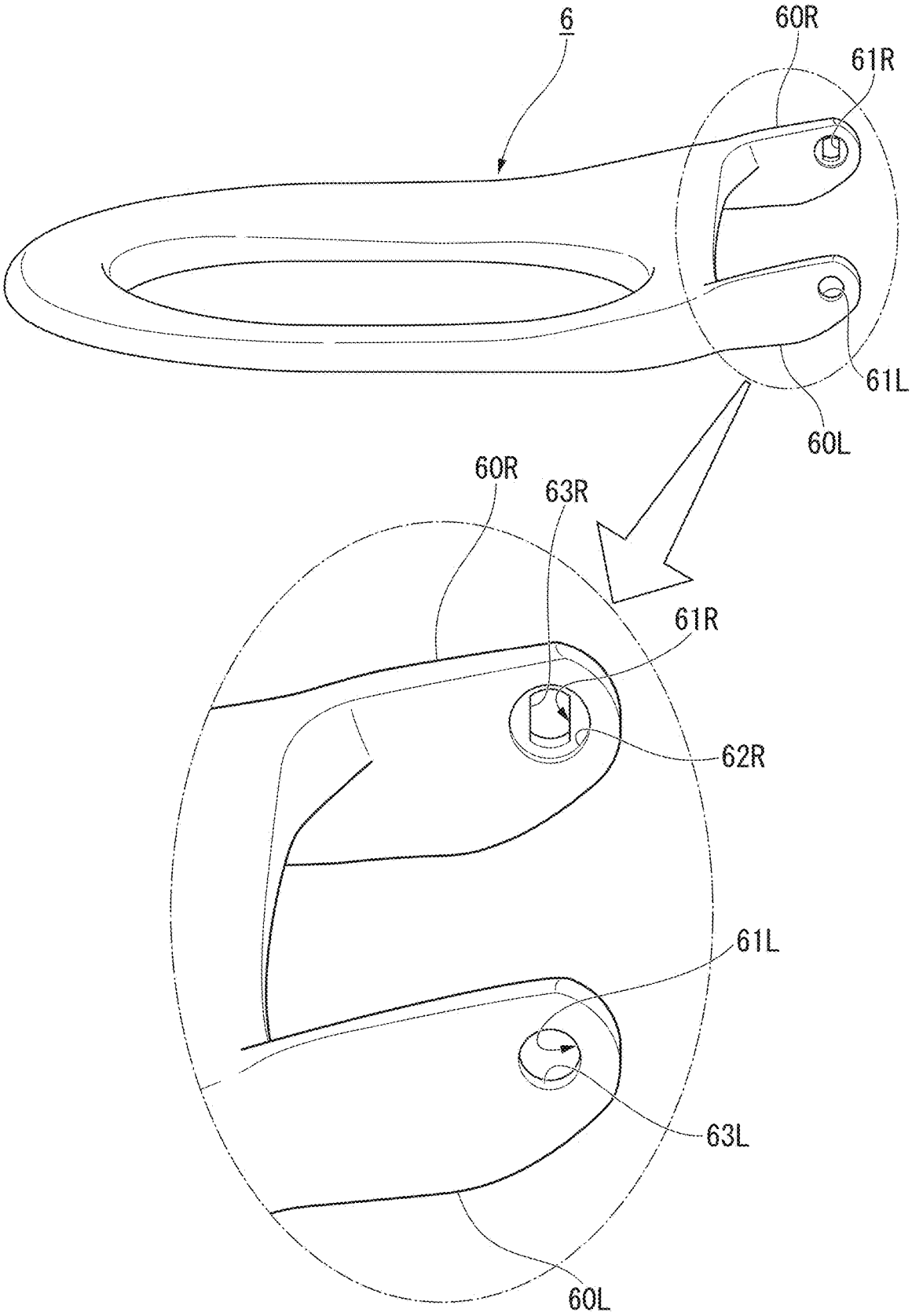
FIG. 6 is a perspective view of a toilet seat of the toilet seat/toilet lid device according to the embodiment of the present invention.
Figure 7:
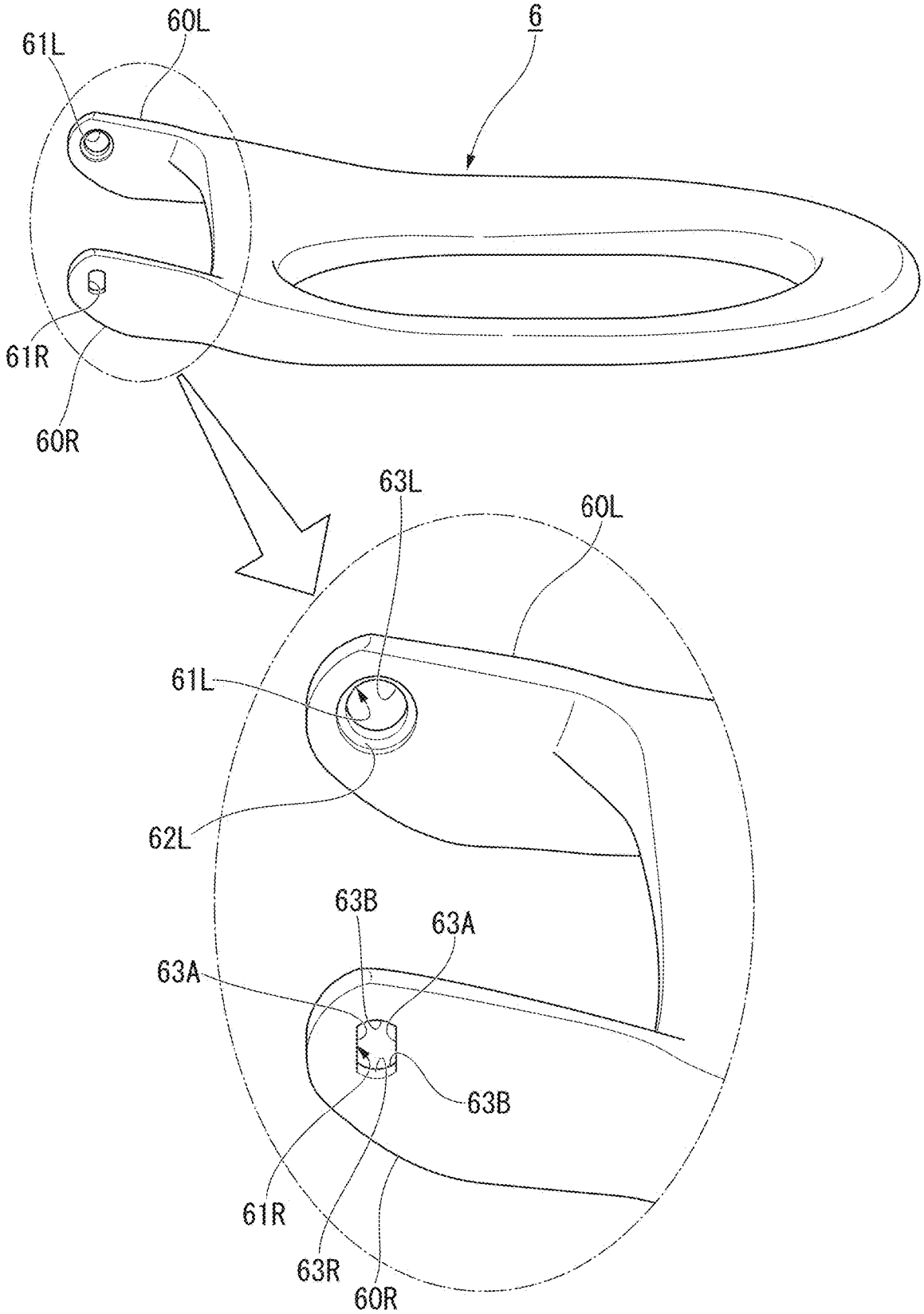
FIG. 7 is another perspective view of the toilet seat of the toilet seat/toilet lid device according to the embodiment of the present invention.

FIG. 6 is a perspective view of the toilet seat 6 seen from the left side. FIG. 7 is a perspective view of the toilet seat 6 seen from the right side.

As shown in FIGS. 6 and 7, the toilet seat 6 is formed to have a substantial ring shape in a plan view. Shaft supporting arm portions 60R and 60L extending rearward are provided on both right and left sides of the rear portion of the toilet seat 6.

The shaft supporting arm portion 60R extends rearward from the right side of the rear portion of the toilet seat 6. A penetration hole 61R is formed while penetrating the shaft supporting arm portion 60R in the lateral direction.

In the penetration hole 61R of the shaft supporting arm portion 60R, an inner hole portion 62R on an inner side (left side) and an outer hole portion (toilet seat side fitting hole) 63R on an outer side (right side) are formed while communicating each other.

The inner hole portion 62R is formed to have a circular cross section corresponding to the shape of the base end shaft portion 41 of the toilet seat pivot shaft 40 (refer to FIG. 4, the same applies hereinafter).

The outer hole portion 63R is formed to have an oval cross section corresponding to the shape of the toilet seat fitting shaft portion 42 of the toilet seat pivot shaft 40 (refer to FIG. 4, the same applies hereinafter). In a state where the toilet seat 6 is closed, the outer hole portion 63R forms a substantially oval shape elongated in the vertical direction. In other words, the outer hole portion 63R is formed to include a pair of flat surface portions 63A which is arranged separately from each other in the front-rear direction and is formed to have a flat surface shape, and curved portions 63B which cause end portions of the pair of flat surface portions 63A to be coupled to each other and are formed to have a curved shape.

Figure 8:
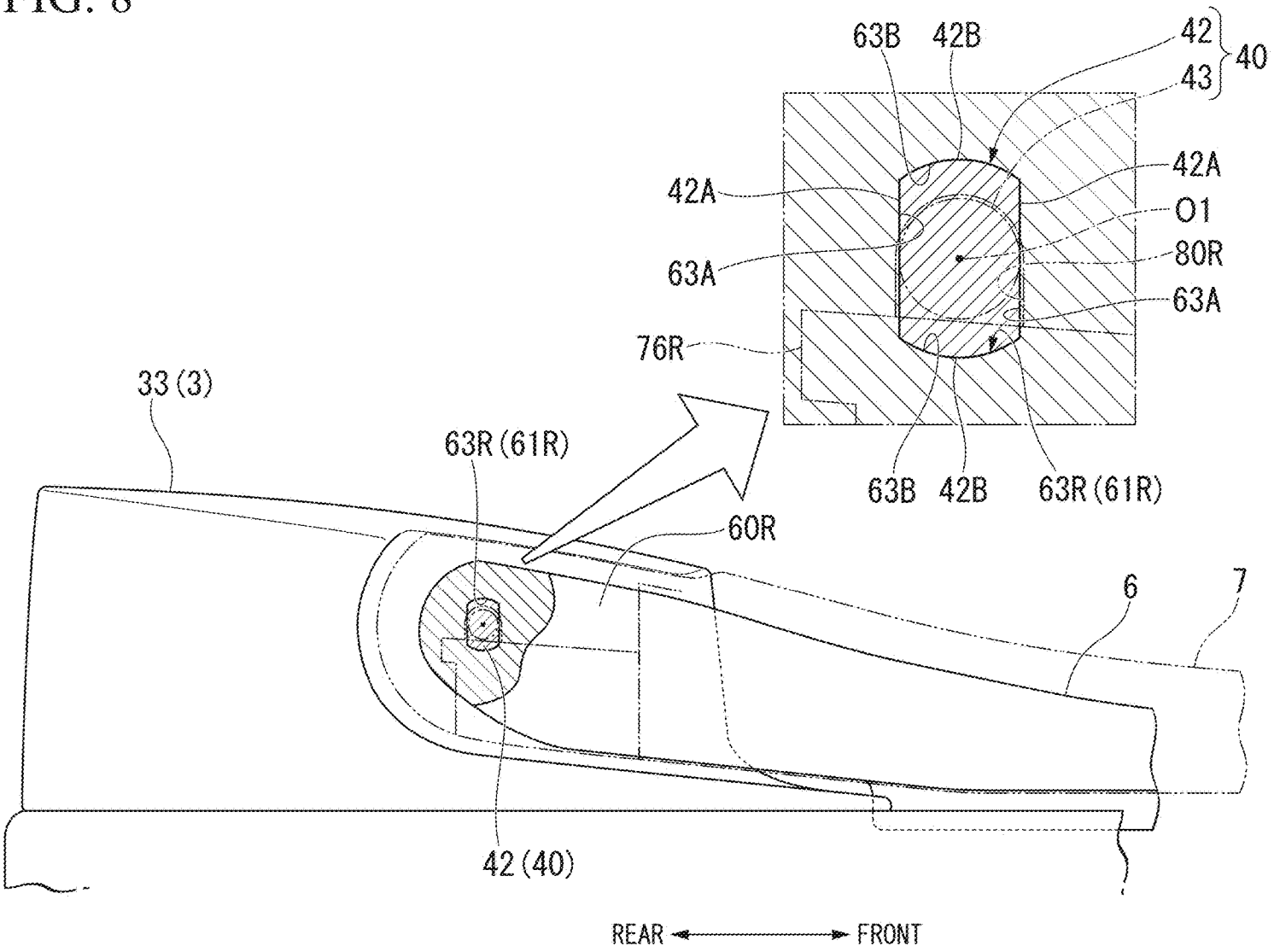
FIG. 8 is a cross-sectional view of a part in the vicinity of the toilet seat pivot shaft in a state where the toilet seat and a toilet lid are closed in the toilet seat/toilet lid device according to the embodiment of the present invention.

FIG. 8 is a cross-sectional view of a part in the vicinity of the toilet seat fitting shaft portion 42 of the toilet seat pivot shaft 40 in a state where the toilet seat 6 and the toilet lid 7 are closed.

As shown in FIG. 8, the toilet seat fitting shaft portion 42 of the toilet seat pivot shaft 40 is fitted into the outer hole portion 63R. Specifically, the toilet seat fitting shaft portion 42 is fitted by the pair of flat surface portions 63A and the pair of curved portions 63B of the outer hole portion 63R. Accordingly, the toilet seat 6 is capable of corotating with the toilet seat pivot shaft 40.

As shown in FIGS. 6 and 7, In a penetration hole 61L of the shaft supporting arm portion 60L, an inner hole portion 62L on the inner side (right side) and an outer hole portion 63L on the outer side (left side) are formed while communicating each other.

The inner hole portion 62L is formed to have a circular cross section corresponding to the shape of the base end shaft portion 51 of the toilet lid pivot shaft 50 (refer to FIG. 5, the same applies hereinafter).

The outer hole portion (toilet seat side supporting hole) 63L is formed to have a completely round cross section slightly greater than the shape of the toilet seat supporting shaft portion 52 of the toilet lid pivot shaft 50 (refer to FIG. 5, the same applies hereinafter). Accordingly, the toilet seat supporting shaft portion 52 of the toilet lid pivot shaft 50 is slidable inside the outer hole portion 63L.

Figure 9:
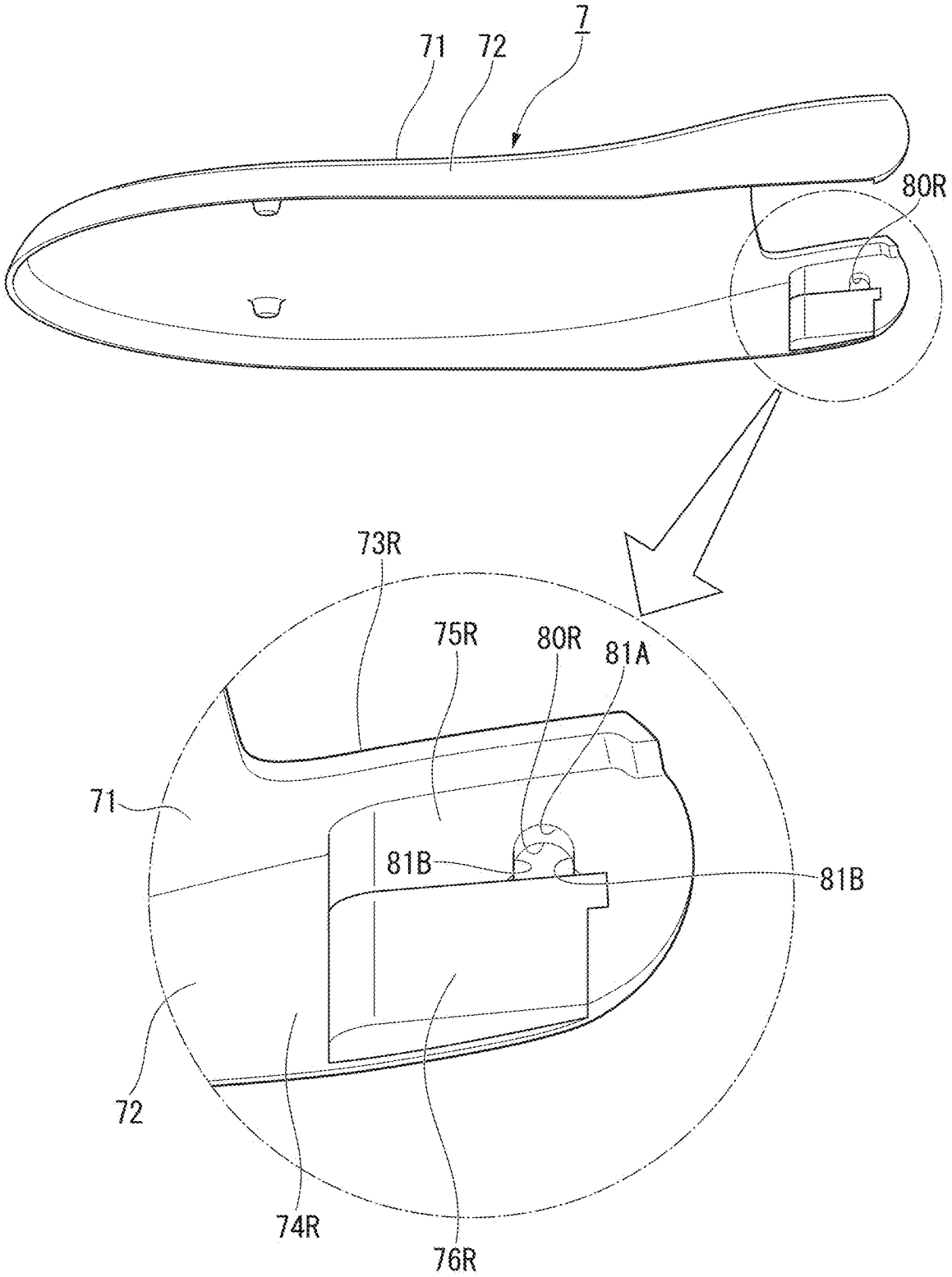
FIG. 9 is a perspective view of the toilet lid of the toilet seat/toilet lid device according to the embodiment of the present invention.
Figure 10:
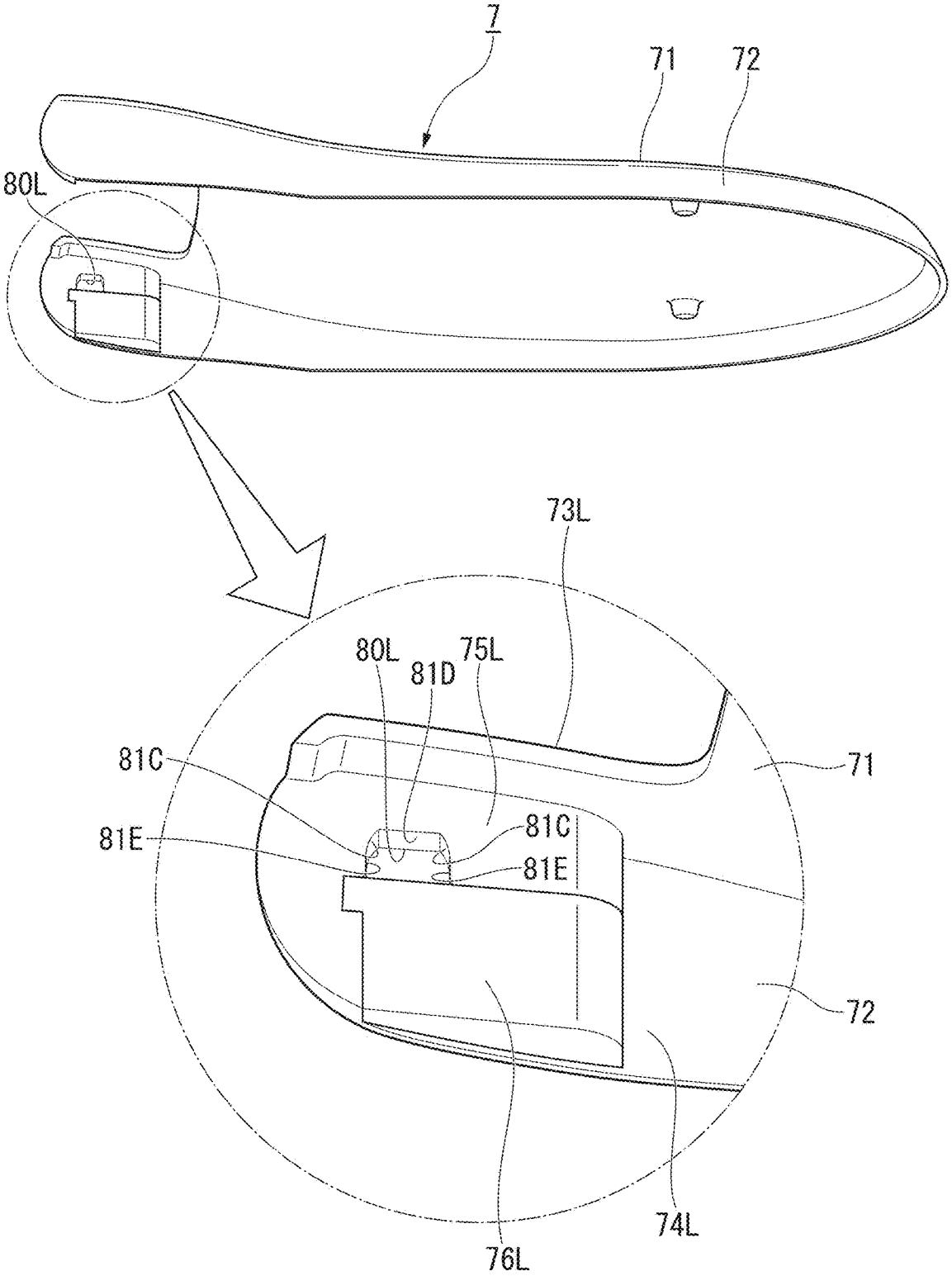
FIG. 10 is another perspective view of the toilet lid of the toilet seat/toilet lid device according to the embodiment of the present invention.

FIG. 9 is a perspective view of the toilet lid 7 seen from the lower left. FIG. 10 is a perspective view of the toilet lid 7 seen from the lower right.

As shown in FIGS. 9 and 10, the toilet lid 7 has an upper surface portion 71 and a side wall portion 72. The upper surface portion 71 forms the upper surface. The side wall portion 72 is hung downward from an edge portion of the upper surface portion 71. Rearward extending portions 73R and 73L extending rearward are provided on both right and left sides on the upper surface portion 71. In addition, shaft support wall portions 74R and 74L extending rearward are also formed in the rear portion of the side wall portion 72.

Swelling portions 75R and 75L swelling toward the shaft support wall portions 74L and 74R on the opposite side are respectively provided on inner surfaces (surfaces on the inner side in the width direction) of the shaft support wall portions 74R and 74L. Slide portions 76R and 76L which are adjacent to the swelling portions 75R and 75L and are slidable in the front-rear direction are provided below the swelling portions 75R and 75L. A supporting hole (toilet lid side supporting hole) 80R and a fitting hole (toilet lid side fitting hole) 80L extending in the lateral direction are respectively formed at lower ends of the swelling portions 75R and 75L.

As shown in FIG. 9, in a state where the toilet lid 7 is closed, an upper portion 81A of the supporting hole 80R is formed to have a completely round cross section swelling upward. The upper portion 81A of the supporting hole 80R is formed to have a completely round cross section slightly greater than the shape of the toilet lid supporting shaft portion 43 of the toilet seat pivot shaft 40 (refer to FIG. 4, the same applies hereinafter).

A lower portion of the supporting hole 80R is formed by a pair of flat surface portions 81B which has a shape connected to the upper portion 81A, is arranged separately in the front-rear direction, and is formed to have a flat surface shape. The clearance between the pair of flat surface portions 81B is slightly longer than the diameter of the toilet lid supporting shaft portion 43 of the toilet seat pivot shaft 40. Accordingly, the toilet lid supporting shaft portion 43 of the toilet seat pivot shaft 40 is slidable inside the supporting hole 80R.

As shown in FIG. 10, an upper portion of the fitting hole 80L has a shape corresponding to the toilet lid fitting shaft portion 53 of the toilet lid pivot shaft 50 (refer to FIG. 5, the same applies hereinafter). The upper portion of the fitting hole 80L is formed by a pair of curved portions 81C being arranged separately in the front-rear direction and being formed to have a curved shape, and an upper flat surface portion 81D causing upper portions of the curved portions 81C to be coupled to each other and being formed to have a flat surface shape. A lower flat surface portion 81E formed to have a flat surface shape is continuously provided in a lower portion of the curved portions 81C to be connected thereto.

Figure 11:
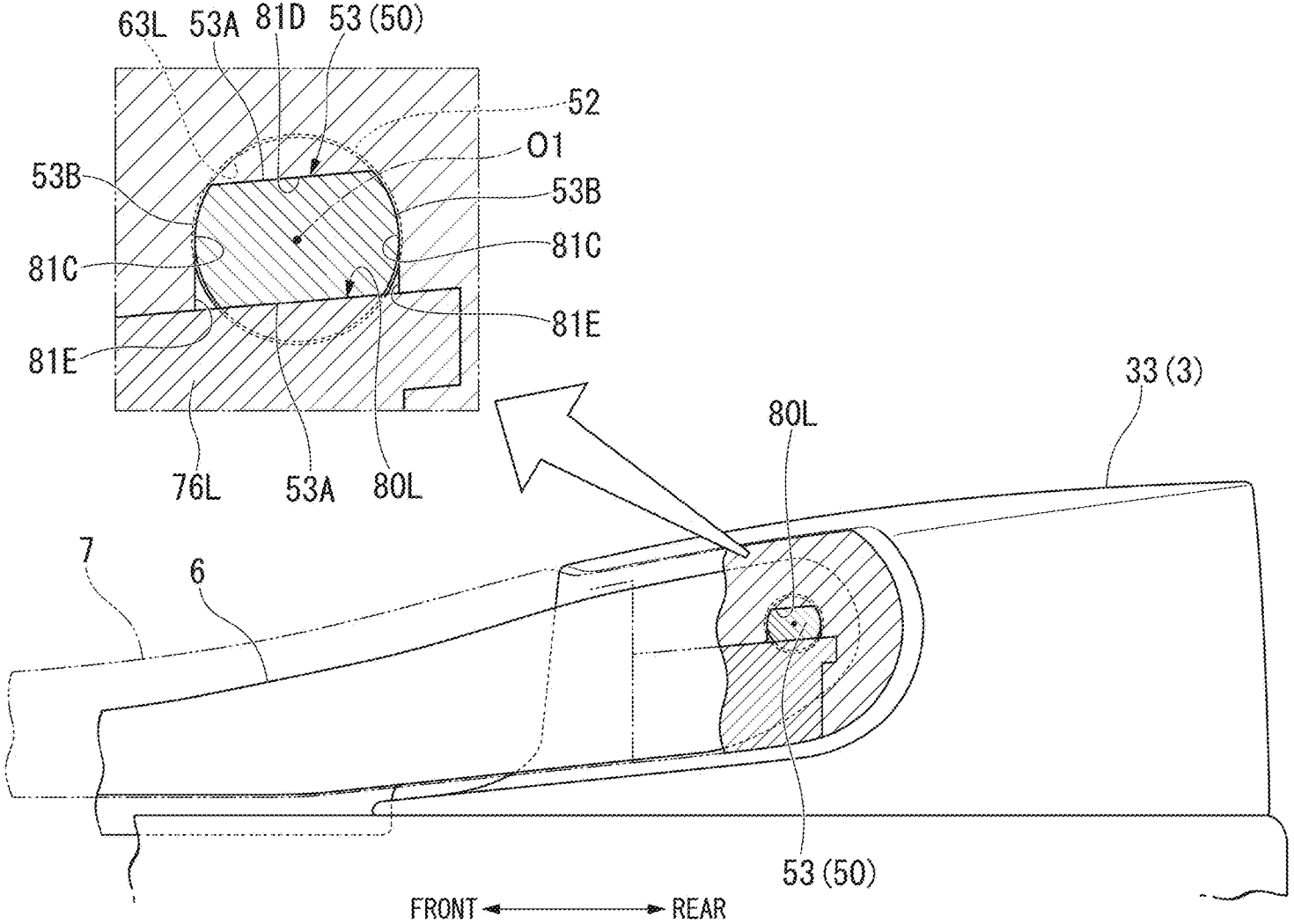
FIG. 11 is a cross-sectional view of a part in the vicinity of the toilet lid pivot shaft in a state where the toilet seat and the toilet lid are closed in the toilet seat/toilet lid device according to the embodiment of the present invention.

FIG. 11 is a cross-sectional view of a part in the vicinity of the toilet lid fitting shaft portion 53 of the toilet lid pivot shaft 50 in a state where the toilet seat 6 and the toilet lid 7 are closed.

As shown in FIG. 11, the toilet lid fitting shaft portion 53 of the toilet lid pivot shaft 50 is fitted into the fitting hole 80L. Specifically, the toilet lid fitting shaft portion 53 is fitted by the pair of curved portions 81C, the upper flat surface portion 81D, and the upper surface of the slide portion 76L. Accordingly, the toilet lid 7 is capable of corotating with the toilet lid pivot shaft 50.

In a state where the slide portions 76R and 76L are moved forward from the positions shown in FIGS. 9 and 10, the toilet seat pivot shaft 40 and the toilet lid pivot shaft 50 are respectively inserted into the supporting hole 80R and the fitting hole 80L. Then, the toilet seat pivot shaft 40 and the toilet lid pivot shaft 50 are supported by the toilet lid 7 by causing the slide portions 76R and 76L to slide rearward to the positions shown in FIGS. 8 and 9.

An operation unit (not shown, the same applies hereinafter) is provided separately from the toilet seat unit 2 shown in FIG. 1 or is provided in the toilet seat unit 2 itself. An input portion (not shown, the same applies hereinafter) for operating opening and closing of the toilet seat 6 and the toilet lid 7 is provided in the operation unit.

A control unit (not shown, the same applies hereinafter) is provided inside the toilet seat unit 2. If an open signal or a close signal for the toilet seat 6 from the input portion is input, the control unit outputs an opening operation signal or a closing operation signal to the toilet seat motor 31 (refer to FIG. 2, the same applies hereinafter). In addition, when an open signal or a close signal for the toilet lid 7 from the input portion is input, the control unit outputs an opening operation signal or a closing operation signal to the toilet lid motor 32 (refer to FIG. 2, the same applies hereinafter).

Next, an operation of the toilet seat unit 2 will be described.

As shown in FIGS. 8 and 11, in a state where the toilet seat 6 and the toilet lid 7 are closed (laid state), if a user inputs an operation of opening the toilet lid 7 to the input portion, the input portion outputs an open signal for the toilet lid 7 to the control unit. The control unit outputs an opening operation signal to the toilet lid motor 32.

Figure 12:
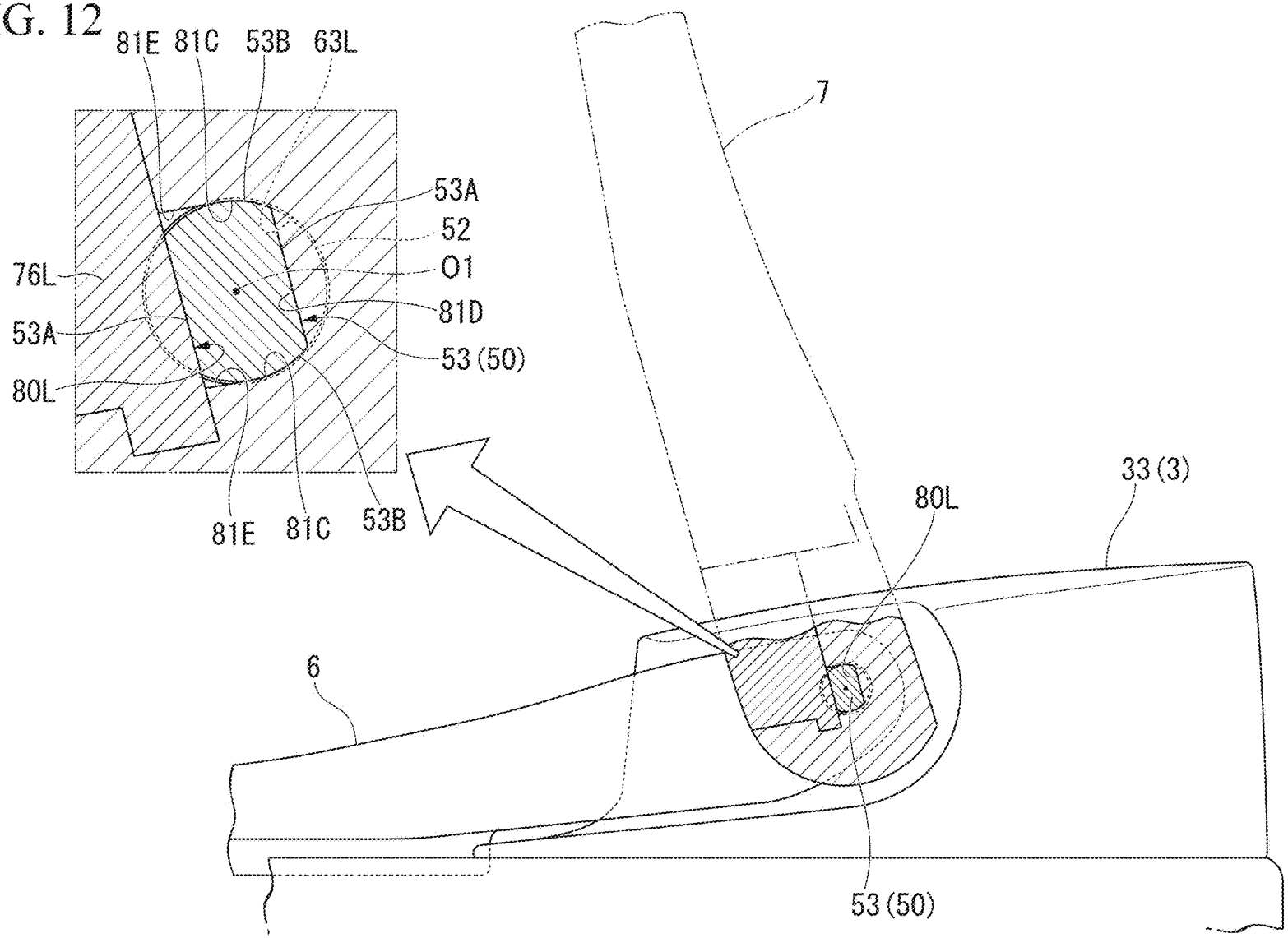
FIG. 12 is a cross-sectional view of a part in the vicinity of the toilet lid pivot shaft in a state where the toilet seat is closed and the toilet lid is opened in the toilet seat/toilet lid device according to the embodiment of the present invention.
Figure 13:
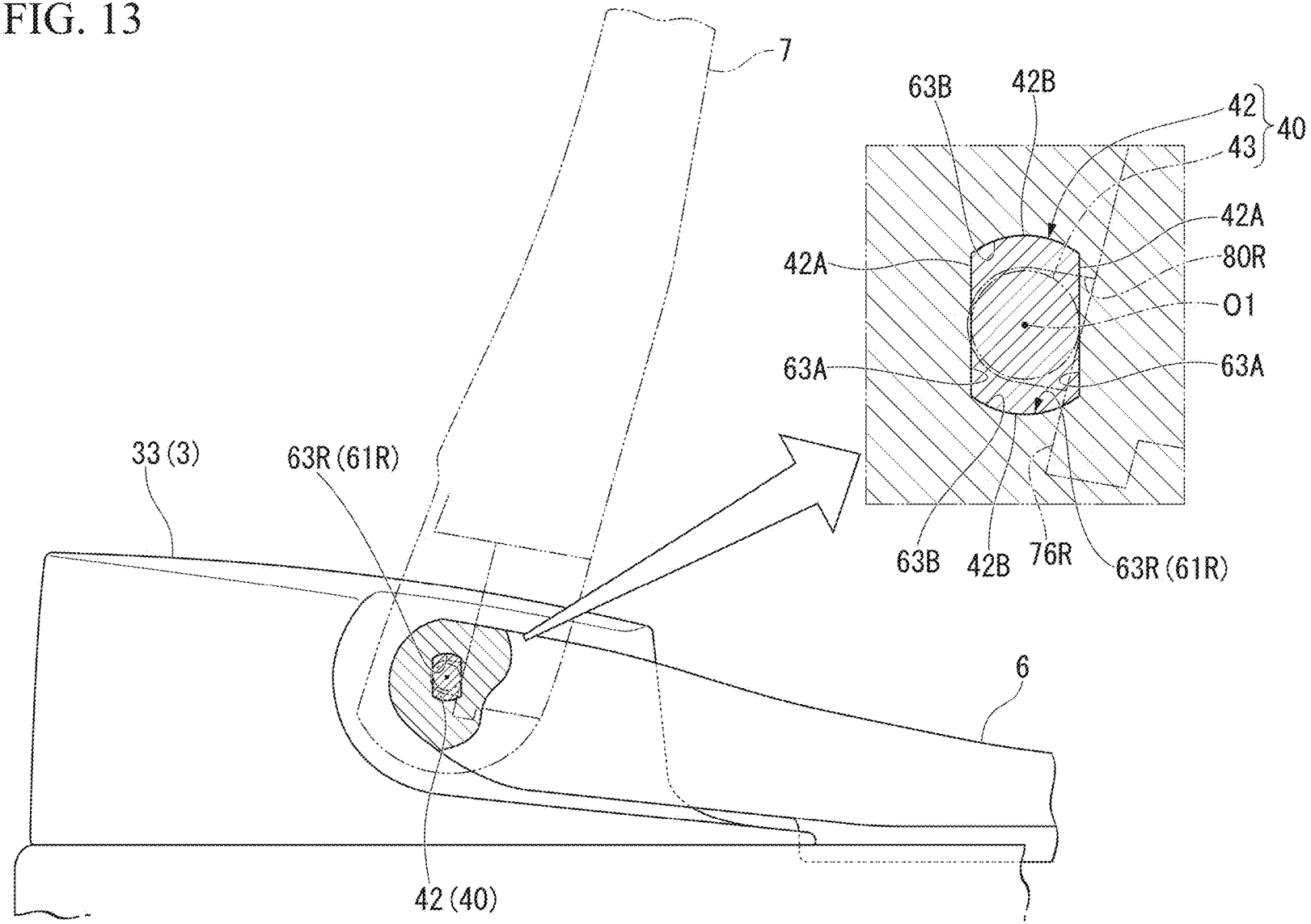
FIG. 13 is a cross-sectional view of a part in the vicinity of the toilet seat pivot shaft in a state where the toilet seat is closed and the toilet lid is opened in the toilet seat/toilet lid device according to the embodiment of the present invention.

FIG. 12 is a cross-sectional view of a part in the vicinity of the toilet lid pivot shaft 50 in a state where the toilet seat 6 is closed and the toilet lid 7 is opened. FIG. 13 is a cross-sectional view of a part in the vicinity of the toilet seat pivot shaft 40 in a state where the toilet seat 6 is closed and the toilet lid 7 is opened.

If an opening operation signal is input, the toilet lid motor 32 causes the toilet lid pivot shaft 50 to pivot in an opening direction. Accordingly, as shown in FIG. 12, the toilet lid 7 fitted to the toilet lid fitting shaft portion 53 of the toilet lid pivot shaft 50 pivots together with the toilet lid pivot shaft 50 and is opened. On the other hand, as shown in FIG. 13, on the toilet seat pivot shaft 40 side, the toilet lid 7 supported by the toilet lid supporting shaft portion 43 of the toilet seat pivot shaft 40 slides around the toilet lid supporting shaft portion 43.

If a user inputs an operation of opening the toilet seat 6 to the input portion, the input portion outputs an open signal for the toilet seat 6 to the control unit. The control unit outputs an opening operation signal to the toilet seat motor 31.

Figure 14:
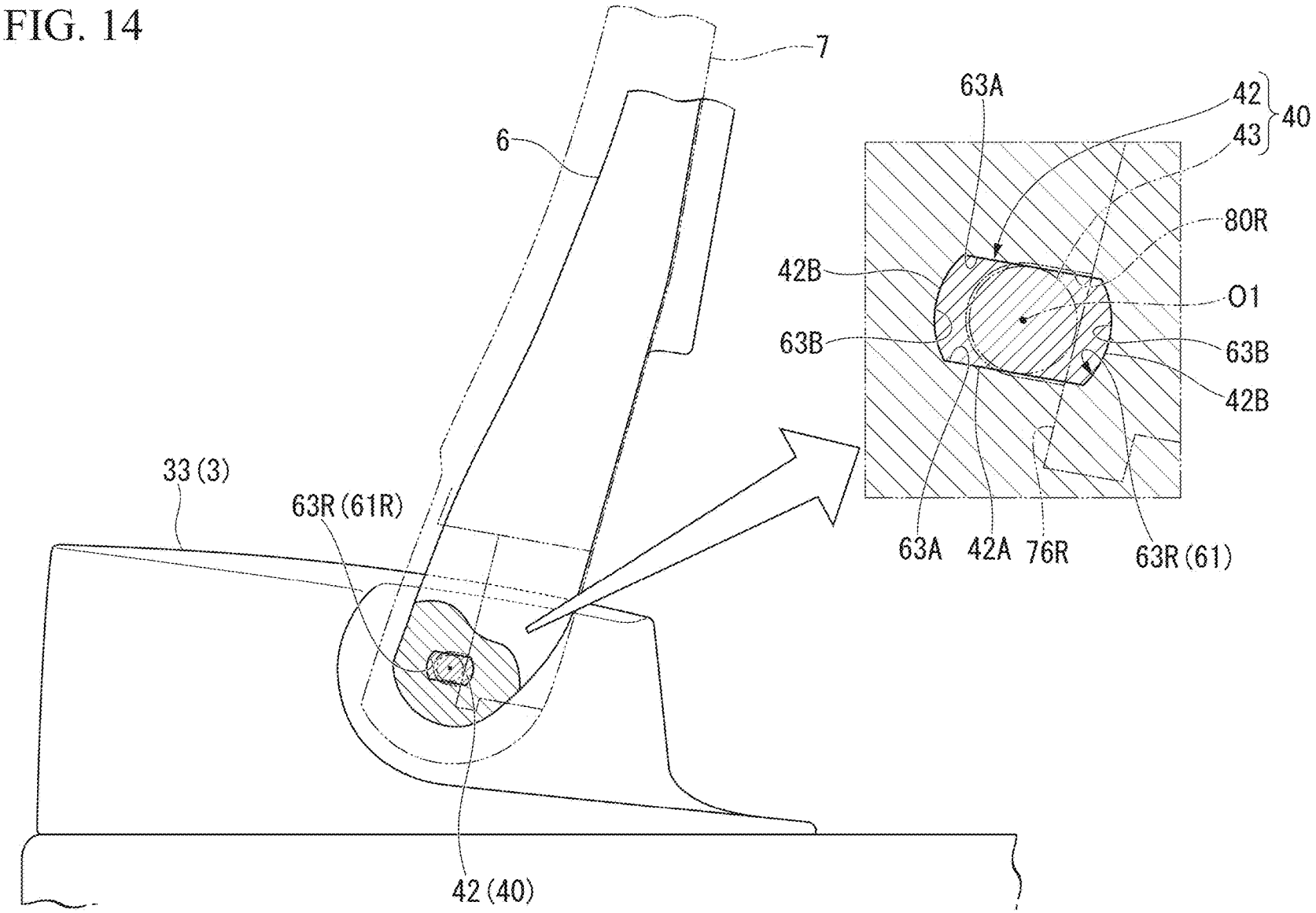
FIG. 14 is a cross-sectional view of a part in the vicinity of the toilet seat pivot shaft in a state where the toilet seat and the toilet lid are opened in the toilet seat/toilet lid device according to the embodiment of the present invention.
Figure 15:
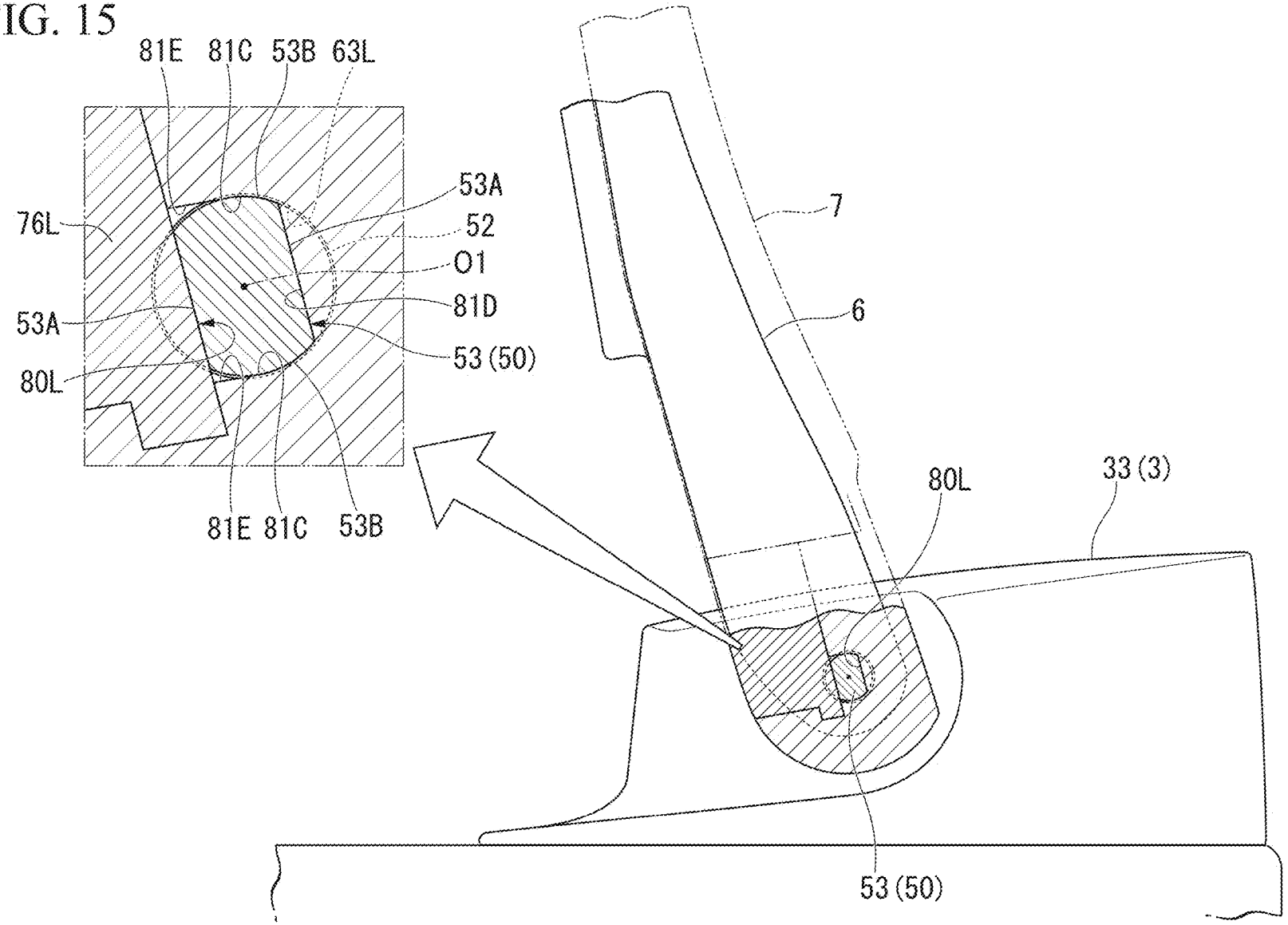
FIG. 15 is a cross-sectional view of a part in the vicinity of the toilet lid pivot shaft in a state where the toilet seat and the toilet lid are opened in the toilet seat/toilet lid device according to the embodiment of the present invention.

FIG. 14 is a cross-sectional view of a part in the vicinity of the toilet seat pivot shaft 40 in a state where the toilet seat 6 and the toilet lid 7 are opened. FIG. 15 is a cross-sectional view of a part in the vicinity of the toilet lid pivot shaft 50 in a state where the toilet seat 6 and the toilet lid 7 are opened.

If an opening operation signal is input, the toilet seat motor 31 causes the toilet seat pivot shaft 40 to pivot in the opening direction. Accordingly, as shown in FIG. 14, the toilet seat 6 fitted to the toilet seat fitting shaft portion 42 of the toilet seat pivot shaft 40 pivots together with the toilet seat pivot shaft 40 and is opened. On the other hand, as shown in FIG. 15, on the toilet lid pivot shaft 50 side, the toilet seat 6 supported by the toilet seat supporting shaft portion 52 of the toilet lid pivot shaft 50 slides around the toilet seat supporting shaft portion 52.

In a state where the toilet seat 6 and the toilet lid 7 are opened (erected state), if a user inputs an operation of closing the toilet seat 6 to the input portion, the input portion outputs a close signal for the toilet seat 6 to the control unit. The control unit outputs a closing operation signal to the toilet seat motor 31.

If a closing operation signal is input, the toilet seat motor 31 causes the toilet seat pivot shaft 40 to pivot in a closing direction. Accordingly, as shown in FIG. 13, the toilet seat 6 fitted to the toilet seat fitting shaft portion 42 of the toilet seat pivot shaft 40 pivots together with the toilet seat pivot shaft 40 and is closed. On the other hand, as shown in FIG. 12, on the toilet lid pivot shaft 50 side, the toilet seat 6 supported by the toilet seat supporting shaft portion 52 of the toilet lid pivot shaft 50 slides around the toilet seat supporting shaft portion 52.

If a user inputs an operation of closing the toilet lid 7 to the input portion, the input portion outputs a close signal for the toilet lid 7 to the control unit. The control unit outputs a closing operation signal to the toilet lid motor 32.

If a closing operation signal is input, the toilet lid motor 32 causes the toilet lid pivot shaft 50 to pivot in the closing direction. Accordingly, as shown in FIG. 11, the toilet lid 7 fitted to the toilet lid fitting shaft portion 53 of the toilet lid pivot shaft 50 pivots together with the toilet lid pivot shaft 50 and is closed. On the other hand, as shown in FIG. 8, on the toilet seat pivot shaft 40 side, the toilet lid 7 supported by the toilet lid supporting shaft portion 43 of the toilet seat pivot shaft 40 slides around the toilet lid supporting shaft portion 43.

The toilet seat 6 and the toilet lid 7 may be configured to be opened at the same time from a state where the toilet seat 6 and the toilet lid 7 are closed, when a user inputs an operation of opening the toilet seat 6 without inputting an operation of opening the toilet lid 7. In addition, the toilet seat 6 and the toilet lid 7 may be configured to be closed at the same time from a state where the toilet seat 6 and the toilet lid 7 are opened, when a user inputs an operation of closing the toilet lid 7 without inputting an operation of closing the toilet seat 6.

In the flush toilet 100 having such a configuration, the toilet seat pivot shaft 40 pivotably supporting the toilet seat 6 and the toilet lid pivot shaft 50 pivotably supporting the toilet lid 7 are arranged on the same axis O1 in the lateral direction of the flush toilet 100. Thus, compared to a case where the toilet seat pivot shaft 40 and the toilet lid pivot shaft 50 are not arranged on the same axis O1 in the lateral direction of the flush toilet 100, it is possible to realize a configuration in which the length of the flush toilet 100 in the front-rear direction and the height of the body portion 3 are suppressed.

In addition, since the toilet seat motor 31 causing the toilet seat pivot shaft 40 to pivot and the toilet lid motor 32 causing the toilet lid pivot shaft 50 to pivot are arranged separately in the lateral direction, compared to a configuration in which the toilet seat motor and the toilet lid motor are collectively installed in one place inside the body portion 3, it is possible to realize a configuration in which the size of the body portion 3, such as the height or the width, is suppressed.

Therefore, it is possible to realize an entirely compact configuration by suppressing the length of the flush toilet 100 in the front-rear direction, the height, and the size.

In addition, since the toilet seat pivot shaft 40 is arranged to be fitted into the outer hole portion 63R formed in the toilet seat 6, when the toilet seat pivot shaft 40 pivots, the toilet seat 6 pivots together with the toilet seat pivot shaft 40. In addition, since the toilet lid pivot shaft 50 is slidably arranged in the outer hole portion 63L formed in the toilet seat 6, the toilet seat 6 slides around the toilet lid pivot shaft 50. Thus, the toilet seat 6 smoothly pivots between an erected state and a laid state.

In addition, since the toilet lid pivot shaft 50 is arranged to be fitted into the fitting hole 80L formed in the toilet lid 7, when the toilet lid pivot shaft 50 pivots, the toilet lid 7 pivots together with the toilet lid pivot shaft 50. In addition, since the toilet seat pivot shaft 40 is slidably arranged in the supporting hole 80R formed in the toilet lid 7, the toilet lid 7 slides around the toilet seat pivot shaft 40. Thus, the toilet lid 7 smoothly pivots between the erected state and the laid state.

The toilet seat fitting shaft portion 42 of the toilet seat pivot shaft 40 is arranged to be fitted into the outer hole portion 63R formed to have a substantially oval cross section corresponding to the shape of the toilet seat fitting shaft portion 42. Thus, when the toilet seat pivot shaft 40 pivots, the toilet seat 6 reliably pivots together with the toilet seat pivot shaft 40. In addition, the toilet seat supporting shaft portion 52 of the toilet lid pivot shaft 50 is slidably arranged in the outer hole portion 63R formed to have a completely round cross section slightly greater than a cross section of the toilet seat supporting shaft portion 52. Thus, the toilet seat 6 reliably slides around the toilet lid pivot shaft 50.

In addition, at least a part of the toilet lid fitting shaft portion 53 of the toilet lid pivot shaft 50 is arranged to be fitted into the fitting hole 80L formed to have a substantially oval cross section corresponding to the shape of the toilet lid fitting shaft portion 53. Thus, when the toilet lid pivot shaft 50 pivots, the toilet lid 7 reliably pivots together with the toilet lid pivot shaft 50. In addition, at least a part of the toilet lid supporting shaft portion 43 of the toilet seat pivot shaft 40 is slidably arranged in the supporting hole 80R formed to have a completely round cross section slightly greater than a cross section of the toilet lid supporting shaft portion 43. Thus, the toilet lid 7 reliably slides around the toilet seat pivot shaft 40.

The flush toilet 100 according to the present invention is not limited to the embodiment described above, and suitable changes, replacements, and the like can be made within a range not departing from the gist of the present invention.

According to the toilet seat/toilet lid device described above, it is possible to realize a compact configuration.

REFERENCE SIGNS LIST

1 toilet main body (toilet)
2 toilet seat unit (toilet seat/toilet lid device)
3 body portion
6 toilet seat
7 toilet lid
31 toilet seat motor (toilet seat drive device)
32 toilet lid motor (toilet lid drive device)
33 casing portion
40 toilet seat pivot shaft
41 base end shaft portion
42 toilet seat fitting shaft portion (oval toilet seat pivot shaft portion)
43 toilet lid supporting shaft portion (completely round toilet lid pivot shaft portion)
50 toilet lid pivot shaft
51 base end shaft portion
52 toilet seat supporting shaft portion (completely round toilet seat pivot shaft portion)
53 toilet lid fitting shaft portion (oval toilet lid pivot shaft portion)
60R, 60L shaft supporting arm portion
61R, 61L penetration hole
62R, 62L inner hole portion
63R outer hole portion (toilet seat side fitting hole)
63L outer hole portion (toilet seat side supporting hole)
75R, 75L swelling portion
76R, 76L slide portion
80R supporting hole (toilet lid side supporting hole)
80L fitting hole (toilet lid side fitting hole)
100 flush toilet
O1 axis

What is claimed is:

1. A toilet seat/toilet lid device comprising:

a toilet seat and a toilet lid that are provided to be pivotable with respect to a toilet between an erected state and a laid state;

a toilet seat drive device that is configured to cause the toilet seat to pivot;

a toilet seat pivot shaft that extends from the toilet seat drive device to one side of the toilet in a lateral direction, pivotably supports the toilet seat, and supports the toilet lid;

a toilet lid drive device that is configured to cause the toilet lid to pivot;

a toilet lid pivot shaft that extends from the toilet lid drive device to the other side of the toilet in the lateral direction, pivotably supports the toilet lid, and supports the toilet seat, wherein the toilet seat pivot shaft and the toilet lid pivot shaft are arranged on the same axis along the lateral direction of the toilet, and in the lateral direction of the toilet seat, the toilet seat drive device and the toilet lid drive device are arranged inside the lateral ends of the toilet seat.

2. The toilet seat/toilet lid device of claim 1, wherein a toilet seat side fitting hole in which the toilet seat pivot shaft is arranged and a toilet seat side supporting hole in which the toilet lid pivot shaft is arranged are formed in the toilet seat, wherein a toilet lid side supporting hole in which the toilet seat pivot shaft is arranged and a toilet lid side fitting hole in which the toilet lid pivot shaft is arranged are formed in the toilet lid, wherein the toilet seat pivot shaft is arranged to be fitted into the toilet seat side fitting hole, is capable of corotating with the toilet seat, and is slidably arranged in the toilet lid side supporting hole, and wherein the toilet lid pivot shaft is slidably arranged in the toilet seat side supporting hole, is arranged to be fitted into the toilet lid side fitting hole, and is capable of corotating with the toilet lid.

3. The toilet seat/toilet lid device of claim 2, wherein the toilet seat pivot shaft has an oval toilet seat pivot shaft portion which is arranged in the toilet seat side fitting hole and is formed to have a substantially oval cross section, and a completely round toilet lid pivot shaft portion which is arranged in the toilet lid side supporting hole and is formed to have a completely round cross section, wherein the toilet lid pivot shaft has a completely round toilet seat pivot shaft portion which is arranged in the toilet seat side supporting hole and is formed to have a completely round cross section, and an oval toilet lid pivot shaft portion which is arranged in the toilet lid side fitting hole and is formed to have a substantially oval cross section, wherein the toilet seat side fitting hole is formed to have a substantially oval cross section corresponding to a shape of the oval toilet seat pivot shaft portion, wherein the toilet seat side supporting hole is formed to have a completely round cross section slightly greater than a cross section of the completely round toilet seat pivot shaft portion, wherein at least a part of the toilet lid side supporting hole is formed to have a completely round cross section slightly greater than a cross section of the completely round toilet lid pivot shaft portion, and wherein at least a part of the toilet lid side fitting hole is formed to have a substantially oval cross section corresponding to a shape of the oval toilet lid pivot shaft portion.

4. A toilet seat/toilet lid comprising:

a toilet seat and a toilet lid that are provided to be pivotable with respect to a toilet between an erected state and a laid state;

a toilet seat drive device that is configured to cause the toilet seat to pivot;

a toilet seat pivot shaft that extends from the toilet seat drive device to one side of the toilet in a lateral direction, pivotably supports the toilet seat, and supports the toilet lid;

a toilet lid drive device that is configured to cause the toilet lid to pivot; and a toilet lid pivot shaft that extends from the toilet lid drive device to the other side of the toilet in the lateral direction, pivotably supports the toilet lid, and supports the toilet seat, wherein the toilet seat pivot shaft and the toilet lid pivot shaft are arranged on the same axis along the lateral direction of the toilet, and the toilet seat drive device and the toilet lid drive device are attached to a casing portion that accommodates the toilet seat drive device, the toilet seat pivot shaft, the toilet lid drive device, and the toilet lid pivot shaft.

* * * * *